US005954244A

United States Patent [19]

Nichol, Jr. et al.

[11] Patent Number: 5,954,244

[45] Date of Patent: Sep. 21, 1999

[54] APPARATUS FOR PROCESSING SOCKS

[75] Inventors: William H. Nichol, Jr., Hopkinsville, Ky.; Harold L. Stone, Mount Airy, N.C.

[73] Assignee: William H. Nichol, Jr., Hopkinsville, Ky.

[21] Appl. No.: 09/150,443

[22] Filed: Sep. 9, 1998

Related U.S. Application Data

[63] Continuation-in-part of application No. 08/925,704, Sep. 9, 1997.

[51] Int. Cl.[6] ..... D06C 15/00

[52] U.S. Cl. ..... 223/60; 223/75; 223/39

[58] Field of Search ..... 223/60, 75–76, 223/77, 39; 206/499

[56] References Cited

U.S. PATENT DOCUMENTS

| | | | |
|---|---|---|---|
| 2,838,217 | 6/1958 | Bowman et al. | 223/60 |
| 2,954,906 | 10/1960 | Lamade, Jr. | 223/60 |
| 3,055,163 | 9/1962 | Ramseier | 206/499 |
| 4,401,244 | 8/1983 | Selvi et al. | 223/60 |
| 5,677,021 | 10/1997 | Weder et al. | 206/499 |

*Primary Examiner*—Bibhu Mohanty
*Attorney, Agent, or Firm*—Kennedy Covington; Lobdell & Hickman, LLP

[57] ABSTRACT

An apparatus for processing socks in nested pairs includes the frame and a plurality of processing stations which may include a trimming station, a pressing station, a printing station, and a doffing station as well as a nesting station. The nesting station includes the frame, an assembly mounted to the frame for supporting and positioning a second sock to be disposed in an overlying relationship with the first sock but with both socks being an extended generally flatten condition. The nesting assembly further includes an assembly mounted to the frame for supporting the first sock in an extended, generally flatten condition including an arrangement for retaining the first sock with the one end thereof and an open condition sufficient to receive the second sock in a generally extended and flatten condition and an assembly mounted to the frame for directing the first sock into an overlying relationship with a second sock resulting in the outer surface of the second sock being in contact with the inner surface of the first sock, thereby nesting the sock.

21 Claims, 14 Drawing Sheets

APPARATUS FOR PROCESSING SOCKS

This is a continuation-in-part of U.S. patent application Ser. No. 08/925,704 for APPARATUS FOR PROCESSING SOCKS filed Sep. 9, 1997.

BACKGROUND OF THE INVENTION

The present invention relates broadly to apparatus for finishing textile products and, more particularly, to an apparatus for processing socks which will perform a plurality of finishing operations automatically with the socks being arranged in nested pairs.

After the initial knitting operations which construct individual socks, several finishing operations are typically performed thereon prior to shipment of the socks for sale. These operations may include clipping or trimming unnecessary textile material from the surface of the socks, pressing the socks to remove substantially all the wrinkles therefrom and printing written information, commercial logos or other indicia on the outer surface of at least one of a pair of socks. It would be advantageous to perform all of these functions in a sequential order on two individual socks arranged in a nested pair.

Apparatus for processing hosiery automatically in a sequential order is disclosed in Takamura et al, U.S. Pat. No. 5,094,371. There, a rotary apparatus is disclosed wherein an indexing turntable advances stockings mounted on templates through various stations, each performing a different operation such as steaming or opening or closing the stockings. The stockings are individually carried on the templates. Bell et al, U.S. Pat. No. 5,511,501 discloses an indexing turntable used for processing hose blanks through a plurality of processing stations. Both of these devices operate with hosiery disposed individually on forms or templates.

SUMMARY OF THE INVENTION

It is accordingly an object of the present invention to provide an apparatus for performing a plurality of individual finishing operations on a nested pair of socks so that once the finishing operations are complete, the socks are essentially ready for shipment.

It is another object of the present invention to provide an apparatus for nesting or pairing individual socks by placing a first sock in an overlying relation with a second sock.

To that end, an apparatus for nesting socks in a generally flattened condition for processing wherein a first sock having an inner surface and an outer surface is disposed in an overlying relation with a second sock having an inner surface and an outer surface with both socks being in the resultant generally flattened condition with the apparatus including a frame, an assembly mounted to the frame for supporting and positioning the second sock in an extended generally flattened condition for overlying by the first sock, an assembly mounted to the frame for supporting the first sock in an extended, generally flattened condition including an arrangement for retaining the first sock with one end thereof in an opened condition sufficient to receive the second sock in a generally extended and flattened condition and an assembly mounted to the frame for directing the first sock into an overlying relationship with the second sock resulting in the outer surface of the second sock being in contact with the inner surface of the first sock, thereby nesting the socks.

It is preferred that the arrangement for supporting and positioning the second sock include a first process board formed as an elongate flattened member projecting outwardly from a support and sized to receive a sock in an overlying relationship therewith.

Preferably, the assembly for supporting the first sock includes a second process board formed as an elongate flattened member projecting outwardly from a support and sized to receive the sock in an overlying relationship therewith and the arrangement for retaining the first sock with one end thereof in an opened condition includes at least one tapered rail attached to the second process board to taper from a narrow extent adjacent a distal end of the second process board to a wide extent adjacent a base portion of the second process board. It is preferred that the assembly for directing the first sock into an overlying relationship with the second sock includes a first slider mounted to the second process board and a first rail operatively engaged with the first slider for sliding movement of the first slider there along, the first rail being mounted to the frame, for moving the first sock between a position beyond the outermost extent of the first process board and a position closely adjacent and substantially parallel with the first process board.

Preferably, the frame includes a second slider mounted thereto with the second slider being mounted to at least one floor standing rail for sliding movement there along for movement of the frame between a position wherein the second process board is not over the first process board and a position where the second process board is over the first process board. It is further preferred that the assembly for directing the first sock into an overlying relationship with the second sock include a third slider attached thereto and a second rail attached to the frame with the third slider operatively engaged with the second rail for sliding movement of the third slider there along, for moving the second process board from a position adjacent the floorstanding rail to a position for receiving the second sock from an operator.

More particularly, it is preferred that the assembly for directing the first sock into an overlying relationship with the second sock include a vertically extending second rail attached to the frame with the third slider operatively engaged with the second rail for vertical sliding movement of the third slider there along for moving the second process board from a position adjacent a support surface to a position for receiving the second sock from an operator, a first vertically extending rail operatively engaged with the first slider for vertical sliding movement of the first slider there along for moving the second process board between a position beyond the outermost extent of the first process board and a position closely adjacent and substantially parallel with the first process board. The second slider is mounted to at least one horizontally extended rail mounted to the support surface for sliding movement there along for horizontal movement of the frame between the position wherein the second process board is not over the first process board and a position where the second process board is over the first process board. All of the above is for sequential movement of the second process board vertically from a position adjacent to the support surface to a first extended position for placement of the first sock on the second process board by an operator, vertical movement of the second process board to a position beyond the outermost extent of the first process board! horizontal movement of the second process board to a position over the first process board, vertical movement of the second process board to a position closely adjacent and substantially parallel with the first process board, and vertical movement of the second process board to a position adjacent the support surface resulting in the movement of the first sock into an overlying relationship with the second sock.

The present invention preferably exists in an apparatus for processing socks in pairs in a generally flattened nested condition, wherein a first sock having an inner surface and an outer surface is disposed in an overlying relation with a second sock having an inner surface and an outer surface with both socks being in the resultant generally flattened condition and the socks enter the apparatus individually and emerge from the apparatus in a paired condition for packaging prior to shipment. The apparatus includes a first floor standing frame including a platform supported on the vertically extending support members; an indexing turntable rotatably mounted to the platform; a second frame associated with the first frame; an assembly mounted to the second frame for supporting and positioning the second sock in an extended generally flattened condition for overlying by the first sock; an assembly mounted to the turntable for supporting the first sock in an extended, generally flattened condition including an arrangement for retaining the first sock with one end thereof in an opened condition sufficient to receive the second sock in a generally extended and flattened condition.

An arrangement is mounted to the second frame for directing the first sock with an overlying relationship with the second sock, resulting in the outer surface of the second sock being in contact with the inner surface of the first sock, thereby nesting the socks. Further included are an arrangement for processing the nested socks mounted to the first frame adjacent the turntable and an assembly for doffing the socks from the assembly for supporting and positioning the second sock, disposed adjacent to the first frame.

Preferably, the assembly for processing the nested socks includes a trimmer for removal of unnecessary textile material projecting from the outer surface of at least the first sock. It is further preferred that the assembly for processing the nested socks includes a presser to press the nested pair for wrinkle reduction. Preferably, the assembly for processing the nested socks includes a printer to selectively print indicia on at least the first sock.

It is preferred that the assembly for doffing the socks includes a pair of arms movable between a position where the distal ends of the arms are closely adjacent one another for sock gripping and a position wherein the arms are spaced from one another for sock release, the arm pair being movable to pull the nested socks from the assembly for supporting and positioning the second sock in an extended generally flattened condition for overlying by the first sock.

It is preferred that the nesting assembly be in accordance with the nesting assembly previously described herein.

In one preferred embodiment, the assembly for nesting the socks is configured so that the first and second socks are in a generally vertically oriented position and the assembly for processing the nested socks is configured for processing the socks in a generally horizontally oriented position. Thus, the nested pair moves from a vertically disposed position to a horizontally disposed position before proceeding through the remainder of the process. In an alternate preferred embodiment, the assembly for processing the nested socks is configured to process the socks in a generally vertically oriented positioned. Thus, the socks remain in a vertically disposed position throughout the nesting of the socks and the remainder of the processing steps.

By the above, the present invention provides an apparatus for performing a plurality of finishing operations on a nested pair of socks. Further, the present invention provides an apparatus for nesting individual socks in pairs.

DESCRIPTION OF THE PREFERRED EMBODIMENT

Figure 1:
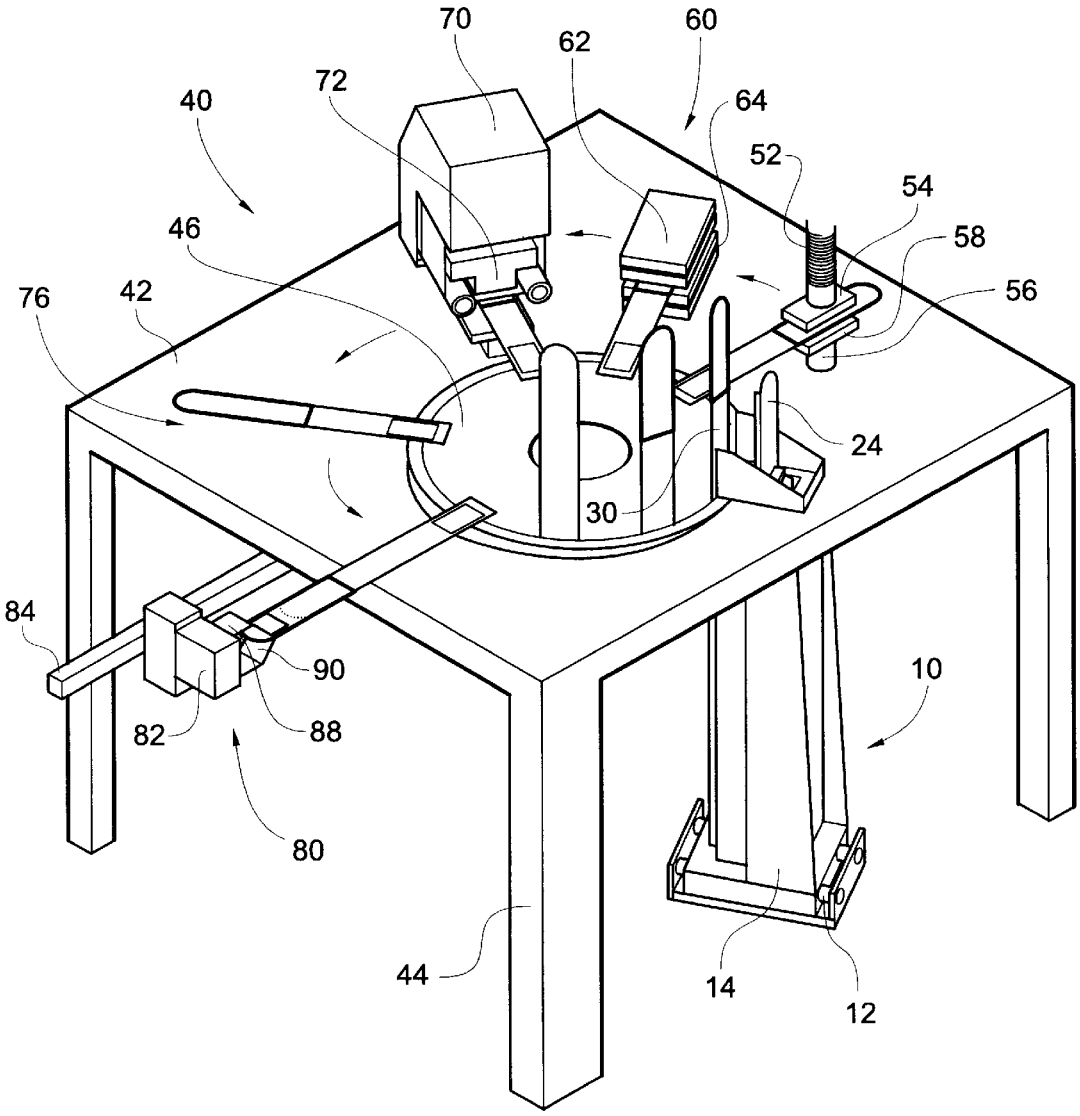
FIG. 1 is a perspective, diagrammatic view, of an apparatus for processing socks according to the first preferred embodiment of the present invention.

Turning now from the drawings and, more particularly, to FIG. 1, an apparatus for processing socks arranged in nested pairs is illustrated generally at 40 and includes a frame formed by a horizontally oriented platform 42 supported by floor standing legs 44 disposed at each corner of the platform 42. It will be understood by those skilled in the art that the present invention is adaptable to many support systems and need not be limited to table-like structures. An indexing turntable 46 is disposed within an opening formed in the platform 42 and is powered for rotating indexing movement. As previously stated, indexing turntables are known generally in many arts and it will be apparent to those skilled in the art how to properly control and drive an indexing turntable for processing objects at a plurality of processing stations.

A plurality of sock processing equipment is disposed in a circular array on the platform 42 around the indexing turntable 46. A sock nester 10 is provided for arranging individual socks into nested pairs and is disposed on the same support surface as is the apparatus frame.

As the turntable 46 is configured for indexing in a counterclockwise manner indicated by arrows in FIG. 1, the remainder of the processing equipment will be described according to the apparatus operational processing order. It should be noted that the device could easily be configured for clockwise motion by rearranging the processing stations. The processing stations are disposed in an order designed to optimize the benefits received by a sock pair undergoing processing by the apparatus. The next station encountered by the socks is a trimmer 50 which includes two generally rectangular housings 54, 58 which are arranged in an opposed, spaced relationship with the spacing being sufficient to pass a pair of nested socks supported on a processing board therethrough.

The housings 54, 58 contain cutters (not shown) for trimming unnecessary textile material which may be projecting from the surface of the socks. Vacuum hoses 52, 56 are connected to the housings 54, 58 for removal of the textile remnants.

A plurality of generally elongate first processing boards 30 are disposed at predetermined spacings around the turntable 46. In the first preferred embodiment, the first processing boards 30 are configured for movements between a generally vertically oriented position for sock nesting and a generally horizontally oriented position for the remainder of the processing steps. The exact structure of the first processing board and its mount will be described in greater detail hereinafter.

From the trimmer 50, the nested pair of socks enters a pressing apparatus 60 which includes two heated platens 62, 64 which are disposed in a spaced parallel relation with one another and configured for movement between a position in pressing relation with the nested sock pair and a position away from the nested sock pair for movement of the nested sock pair through the pressing apparatus 60.

A printer 70 is provided next after the presser and includes an ink platen 72 for movement into and out of printing relation with a pair of socks disposed within the printer 70. It should be understood that the printer 70 can be one of several types depending on the specific requirements of the user of the apparatus.

From there, a free position 76 is provided for future expansion of the apparatus 40. Any other processing device as necessary may be provided, for example, a banding station may fill the free position 76.

Finally, the first preferred embodiment of the present invention includes a doffing station 80 including a generally rectangular, elongate rail 84 projecting away from an underside of the platform 42. A sliding housing 82 is mounted to the rail 84 for selective sliding movement there along.

Two arms, 88, 90 project outwardly from the housing 82 in a curved manner for grasping a pair of socks disposed on a first platform intermediate the arms. The arms 88, 90 are 'movable between a position for grasping socks and a position for releasing socks as will be seen in greater detail hereinafter.

One of the primary features of the present invention is its ability to process socks in generally flattened, nested pairs. To that end, a sock nester 10 is provided as seen in FIG. 1 to include a primary frame 14 projecting-upwardly from a slider 16 mounted to horizontally extending rails 12 supported on the same support surface as the primary frame.

The nester frame 14 is a generally vertically projecting frame having laterally extending panels mounted thereto. A first rail 18 is vertically mounted to the frame 14. A second rail 20 formed similarly to the first rail 18 is mounted to the first rail 18 with a slider 22 for vertical sliding movement of the second rail 20 relative to the first rail 18. The slider 22 is mounted near one end of the second rail 20 and slidably engaged with the first rail 18 thereat. A processing board 24 for opening a sock is mounted to the second rail 20 using another slider 26 fixed to the process/opening board 24 and slidably mounted to the second rail for vertical movement there along. Tapered rails 25 are mounted to the process/opening board 24 along side edges thereof to taper from a narrow extent adjacent the distal end of the process/opening board 24 to a wide extent adjacent the slider 26. Optionally, the rails 25 may curve inwardly for reasons that will come clear hereinafter.

It has been shown that the nester includes three sliders, one slider 16 mounted to the frame 14 and slidably mounted to horizontal rails 12 for horizontal movement of the entire nesting frame 14. A second slider 22 is mounted to the first rail 18 for vertical movement of the process/opening board 24 between a position that will not interfere with turntable movement to a position engageable by an operator for placement of the sock on the process/opening board 24. Another slider 26 is mounted to the process/opening board 24 for vertical movement thereof between the position accessible by an operator to a position above the second process/index board 30 and back down again. It will be understood by those skilled in the art that movement of the various components including the frame 14, rail 20 and process/opening board 24 may be achieved by various known means including hydraulic or pneumatic pistons/cylinder assemblies with appropriate timing of the movement being attained by microprocessor based control equipment.

Figure 2B:
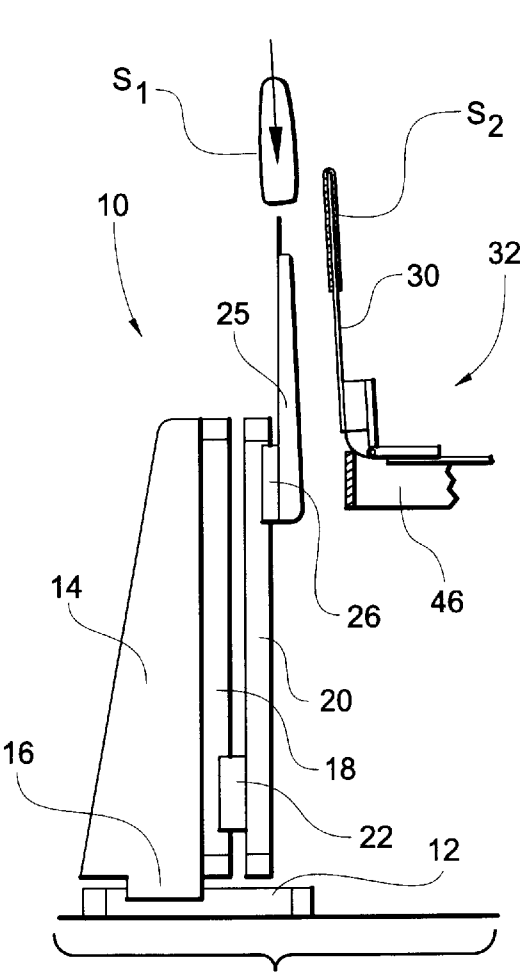
FIG. 2*b* is a side view of the apparatus for nesting socks receiving a first sock on the second process board.

As seen in FIG. 2*b*, the process/opening board 24 is configured to receive a first sock S1 disposed thereon with the inner surface of the first sock S1 engaged with the rails 25 associated with the process/opening board 24 to retain the sock S1 in an opened condition. The remainder of the nesting operation will be explained in greater detail hereinafter.

Figure 2A:
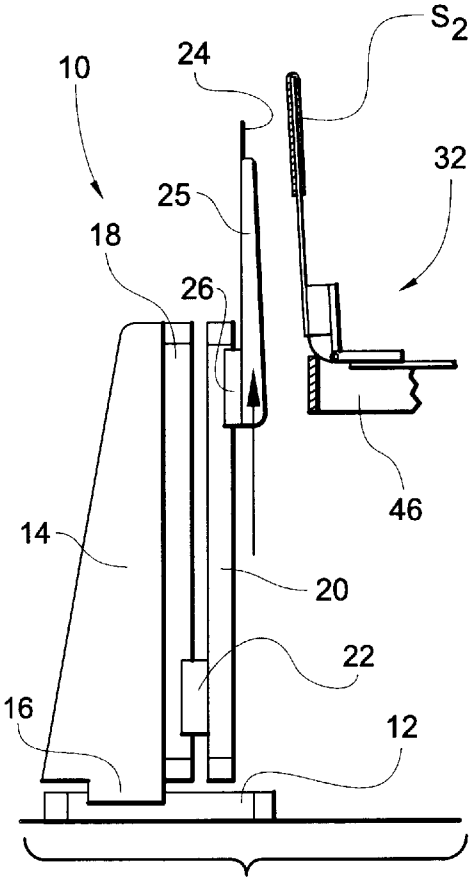
FIG. 2*a* is a side view of the apparatus for nesting socks with the second process board at a first extended position.
Figure 2:
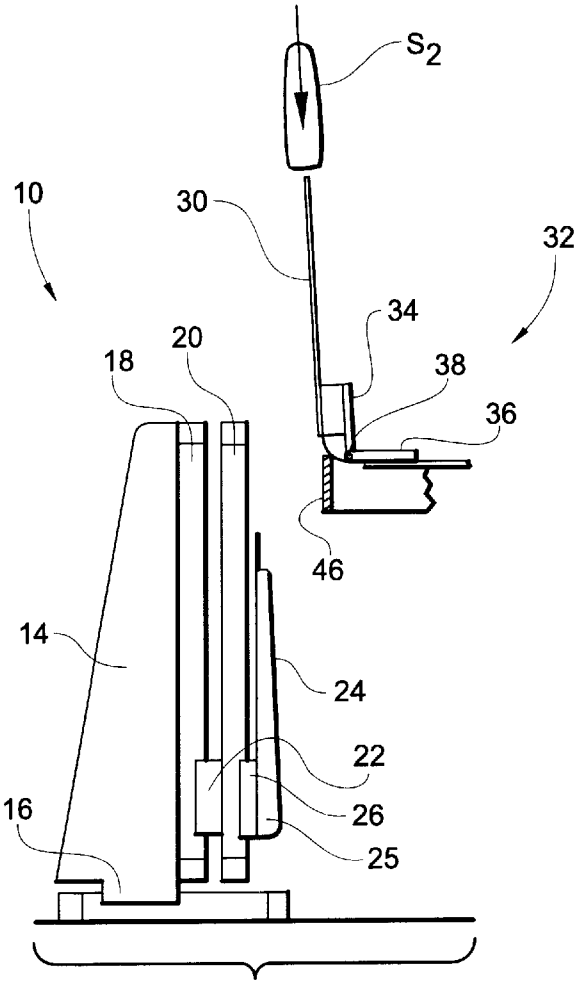
FIG. 2 is a side view of an apparatus for nesting socks according to the first preferred embodiment of the present invention with the process boards in an initial condition.
Figure 3:
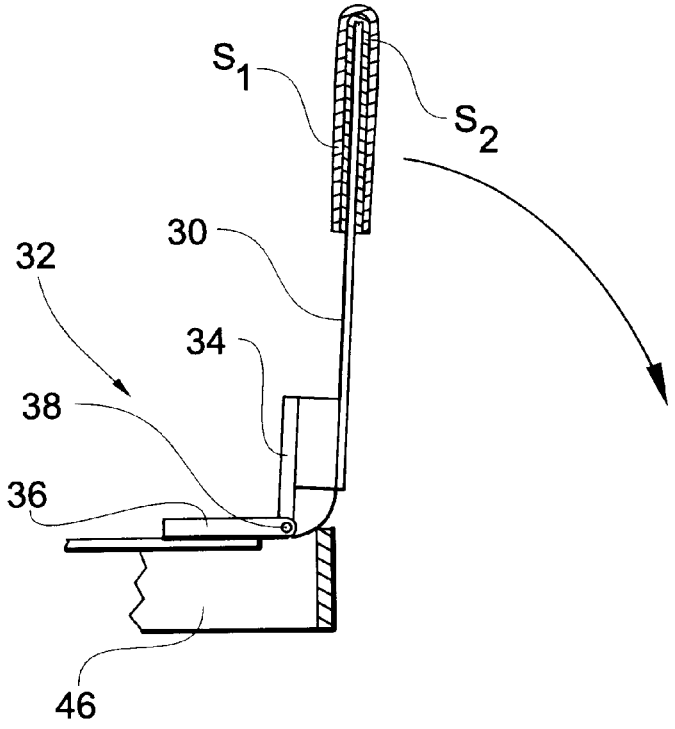
FIG. 3 is a side view of the nested pair of socks disposed on the first process board of the first preferred embodiment in a vertically extended manner.
Figure 3A:
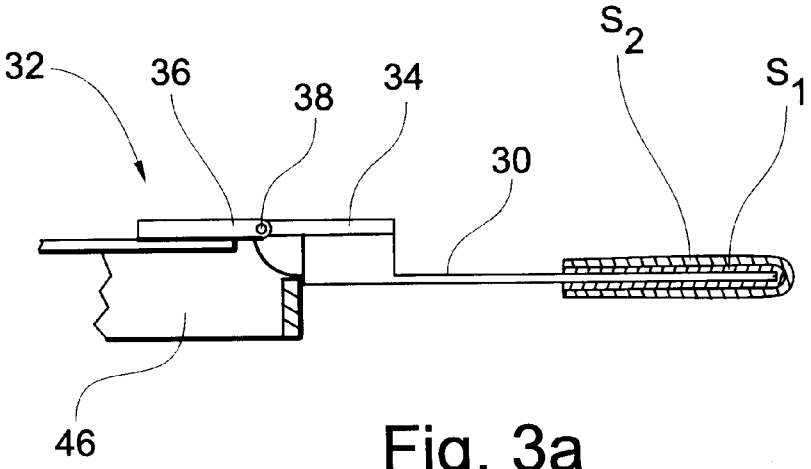
FIG. 3*a* is a side view of the first process board holding a nested pair of socks in a horizontal position.

Turning now to FIGS. 2, 3 and 3*a*, a first process/indexing board 30 is formed as a generally vertically extending, flat member, narrow in the beam and curved at one end. This configuration allows the process/index board 30 to support a second sock S2 as seen in FIGS. 2 and 2*a*. The process/index board 30 is one of several mounted to the turntable 46 and disposed at predetermined intervals there around as seen in FIG. 1. Returning to FIG. 2, the process/index board 30 is mounted to a first support member 34 which, in turn, is mounted to a second support member 36 which is mounted to the index turntable 46. In the first preferred embodiment, the first support member 34 is mounted to the second support member 36 using a pinned hinge 38.

As seen in FIGS. 3 and 3*a*, the process/index board 30 of the first preferred embodiment is movable between a generally vertically extending position for nesting operations and a generally horizontally extending position for the remainder of the finishing operations. Once again, it will be understood by those skilled in the art, that the movement of the process/index board may be induced by pneumatic piston/cylinder arrangements, motor drives with gears or belts, or any of a number of drive mechanisms.

In operation, an operator (not shown) takes station at the platform 42 with a sock supply (not shown). The operator will place socks individually on the process/index board 30 and the process/opening board 24. According to a predetermined timed arrangement, the control system (not shown) advances the process/index boards one position after a pair of socks is nested. In order to nest a pair of socks, reference is made to FIGS. 2 and 2*a*–*i*. Initially, as seen in FIG. 2, the nester 10 is at its initial position and the operator places a second sock S2 on the process/index board 30.

As seen in FIG. 2*a*, the process/opening board 24 is raised to its first position and the operator inserts the first sock S1 thereover as seen in FIG. 2*b*. This results in the configuration seen in FIG. 2*c* with both socks S1, S2 disposed on their respective boards 24, 30.

Figure 2E:
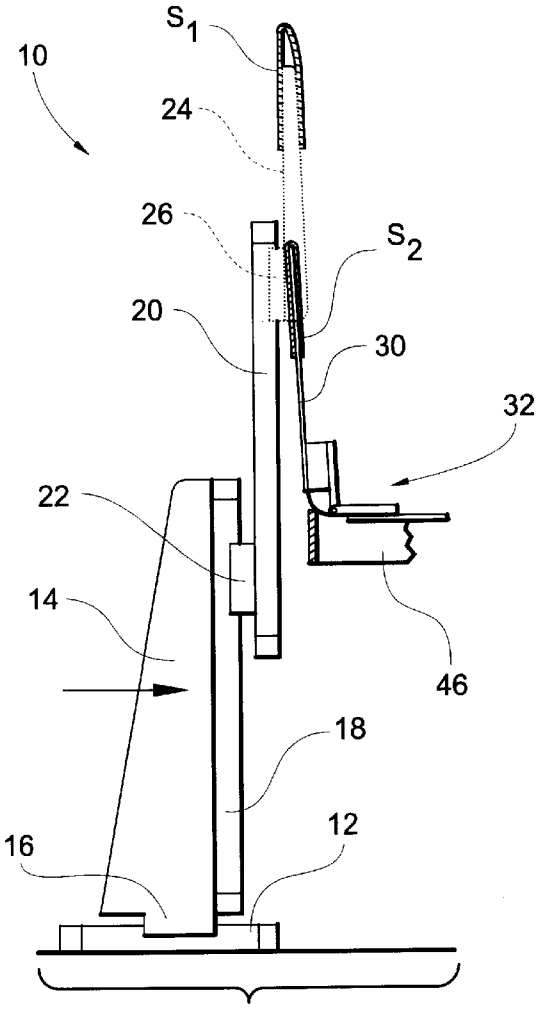
FIG. 2*e* is a side view of the apparatus for nesting socks with the frame advanced to a position wherein the second process board is over the first process board.
Figure 2D:
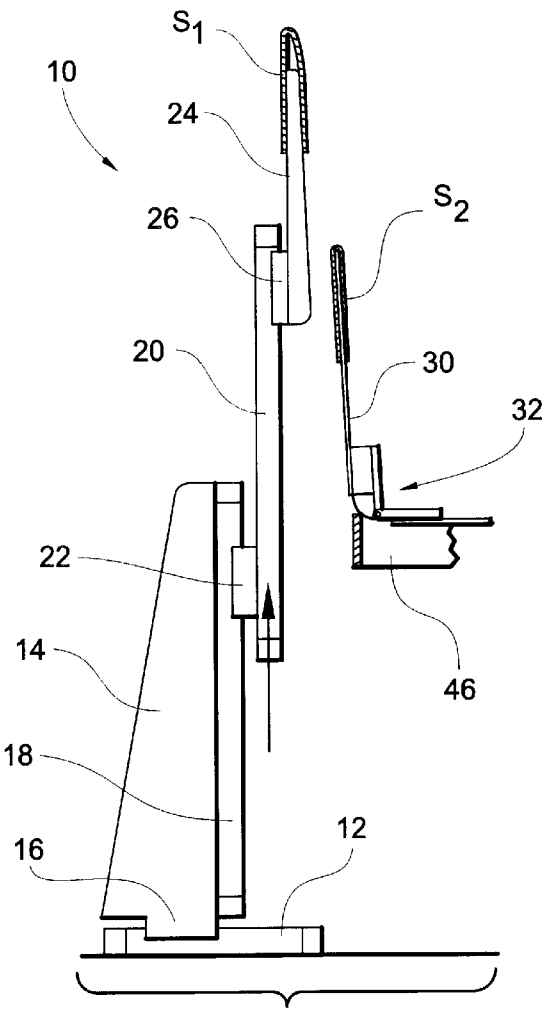
FIG. 2*d* is a side view of the apparatus for nesting socks with the second process board in its fully extended position.
Figure 2C:
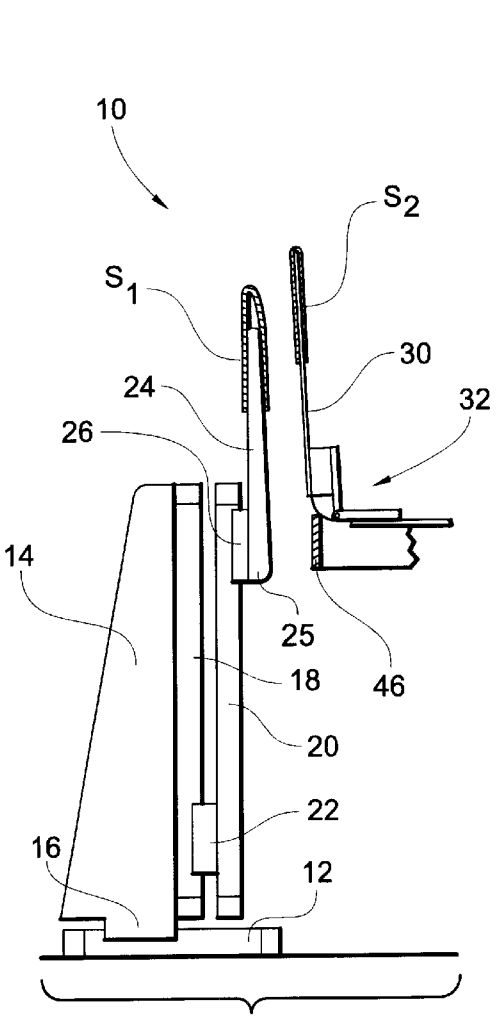
FIG. 2*c* is a side view of the apparatus for nesting socks with socks disposed on both process boards.

As seen in FIG. 2*d*, the second rail 20 is propelled upwardly to the second extended position wherein the first sock S1 is extended beyond the outermost extent of the second sock S2.

As seen in FIG. 2*e*, the frame 14 is caused to move horizontally forward with the slider 16 moving horizontally along the horizontally extending rail 12. This movement occurs until the process/index board 30 and the second sock S2 are closely adjacent and substantially parallel with the process/opening board 24 and the first sock S1.

Figure 2H:
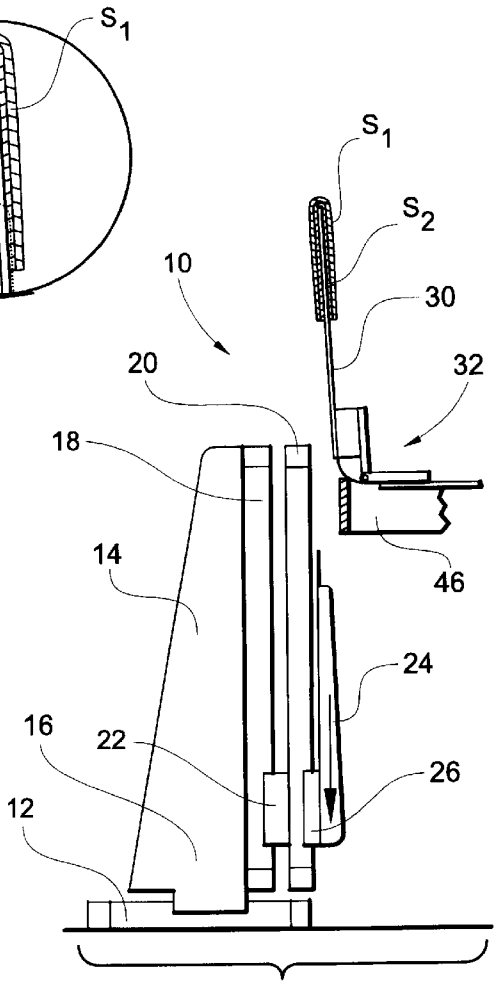
FIG. 2*h* is a side view of the apparatus for nesting socks with the second process board drawn away from the first sock leaving the first and second socks in a nested relationship.
Figure 2G:
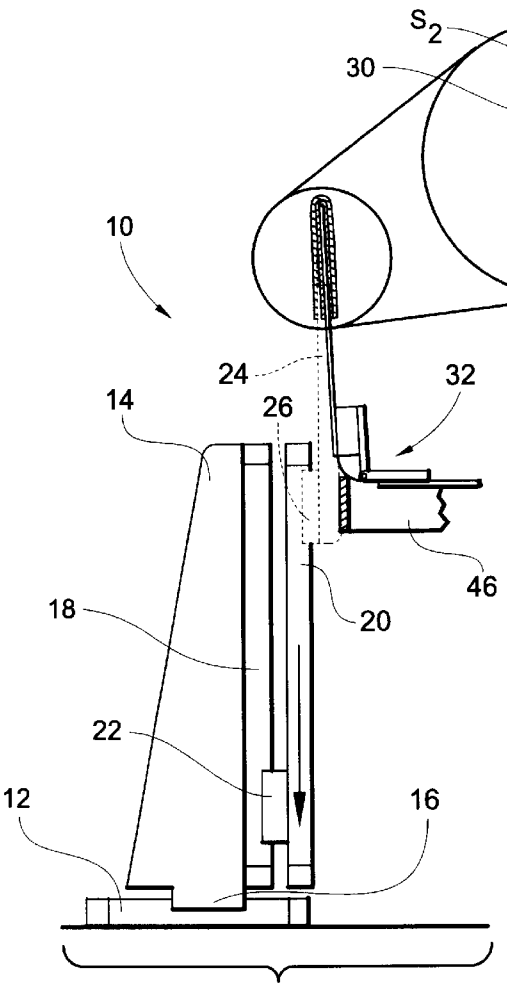
FIG. 2*g* is a side view of the apparatus for nesting socks with the second process board closely adjacent and parallel to the first process board.
Figure 2F:
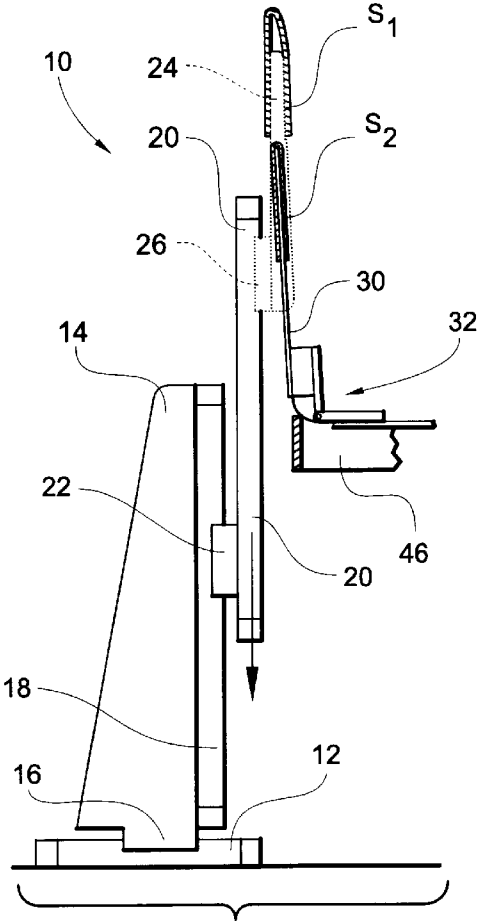
FIG. 2*f* is a side view of the apparatus for nesting socks with the second process board descending.
Figure 2I:
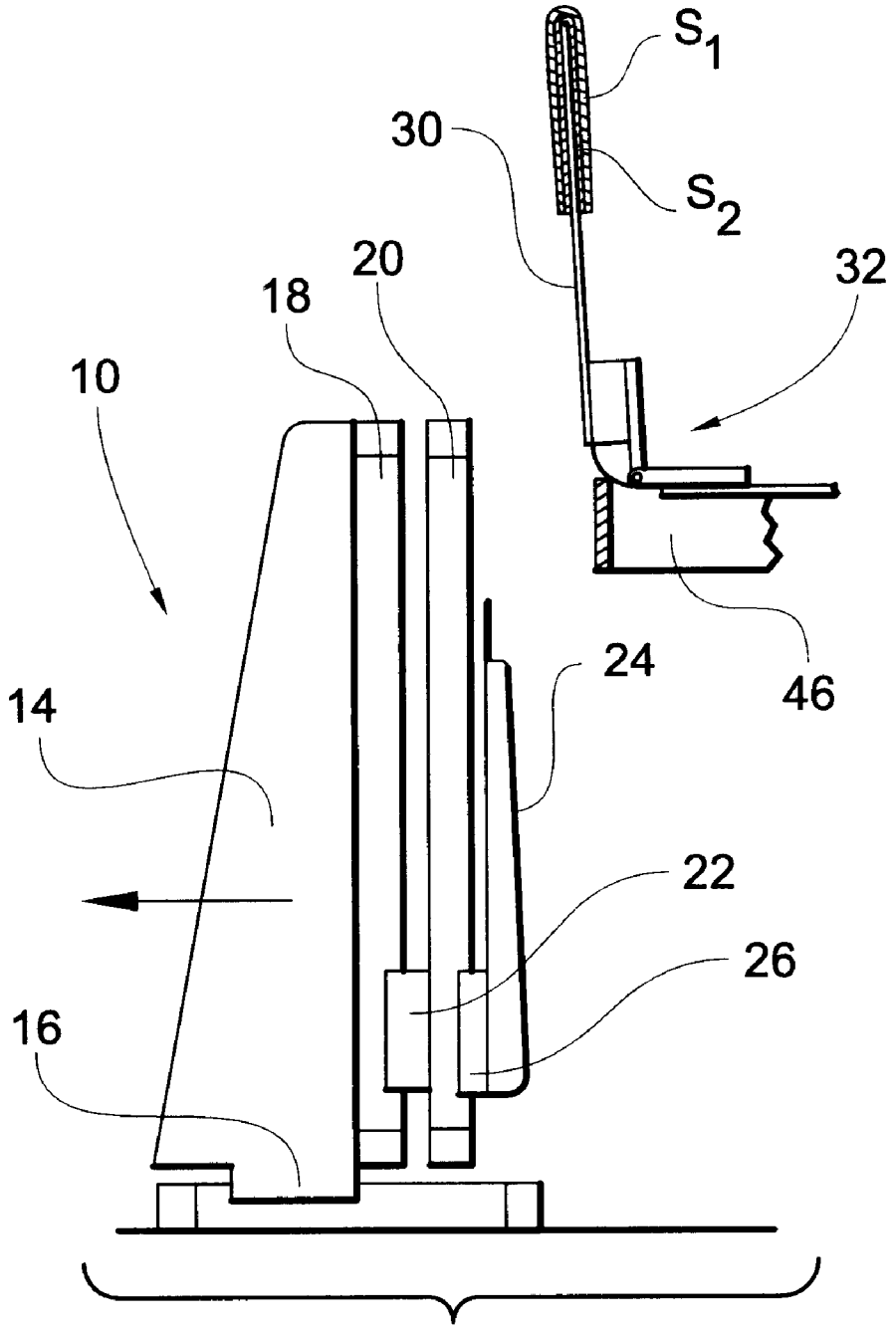
FIG. 2*i* is a side view of the apparatus for nesting socks with the frame moving horizontally away from the first process board.
Figure 3B:
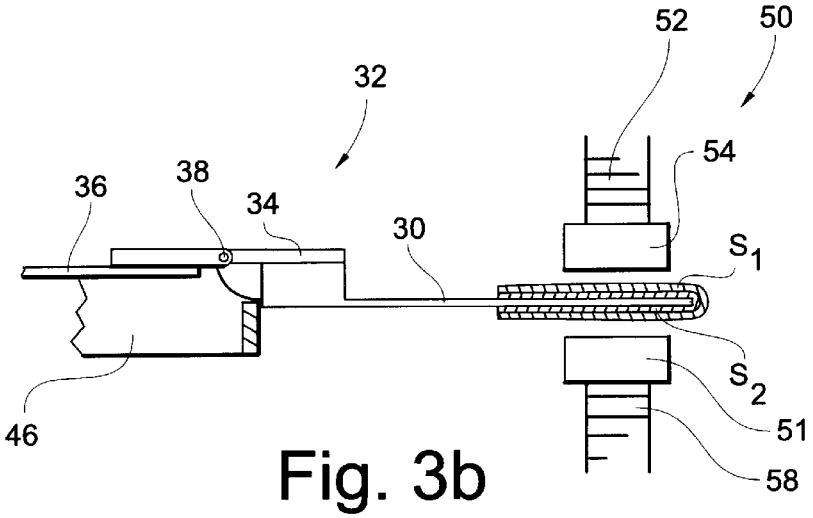
FIG. 3*b* is a side view of a nested pair of socks being addressed by the trimmer.
Figure 3C:
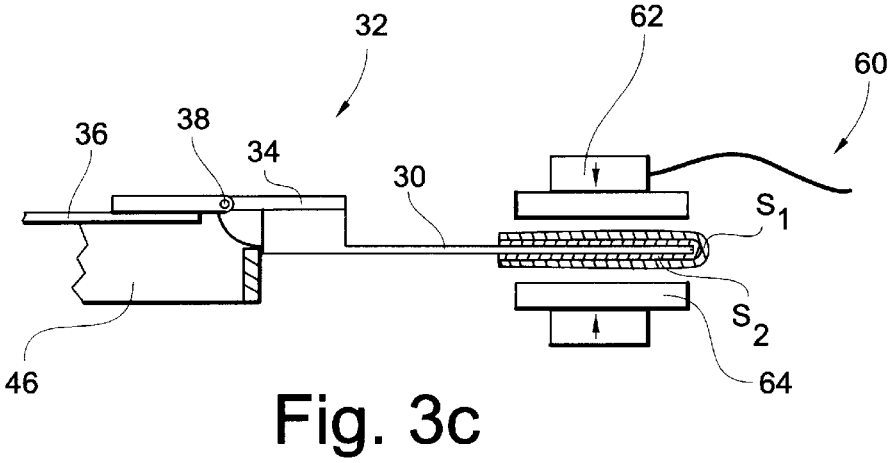
FIG. 3*c* is a side view of a nested pair of socks being addressed by the presser.
Figure 3D:
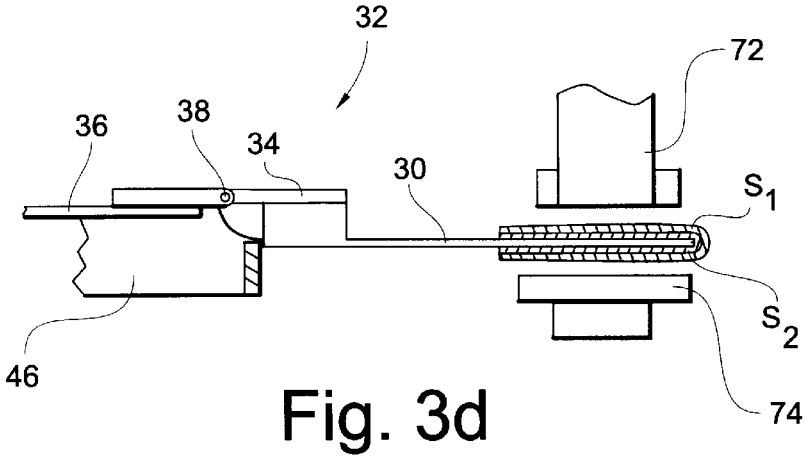
FIG. 3*d* is a side view of a nested pair of socks being addressed by the printer.

Turning now to FIG. 2*f*, the next step is that the second rail 20 is caused to descend with the slider 22 moving along the first rail 18 to bring the first, open sock S1 downwardly into a covering relation with the second sock S2 mounted to the process/index board 30. As seen in FIG. 2*g*, the inner surface of the first sock S1 is in abutment with the outer surface of the second sock S2. As seen in FIG. 2*h*, the process/opening board 24 is caused to descend with the slider 26 moving along the second rail 20 to a position away from the process/index board 30 and the turntable 46. Finally, as seen in FIG. 2*i*, the frame 14 is caused to move horizontally away from the indexing turntable 46. As seen in FIG. 3 and 3*a* of the first preferred embodiment, the nested pair S1, S2 is disposed on the vertically extending process/index board 30 which moves from a vertical position as seen in FIG. 3 to a horizontally extending position as seen in FIG. 3*a*. From there, as seen in FIG. 3*b*, the socks S1, S2 are indexed to a position intermediate the trimming housings 54, 58 where trimming occurs. From there, as seen in FIG. 3, the socks S1, S2 are indexed to a position within the pressing unit 60 intermediate the heated platens 62, 64 where pressing occurs. As seen in FIG. 3*d*, the next indexing step positions the socks S1, S2 intermediate the platens of the printing unit 72 where information is affixed to the socks.

Figure 3E:
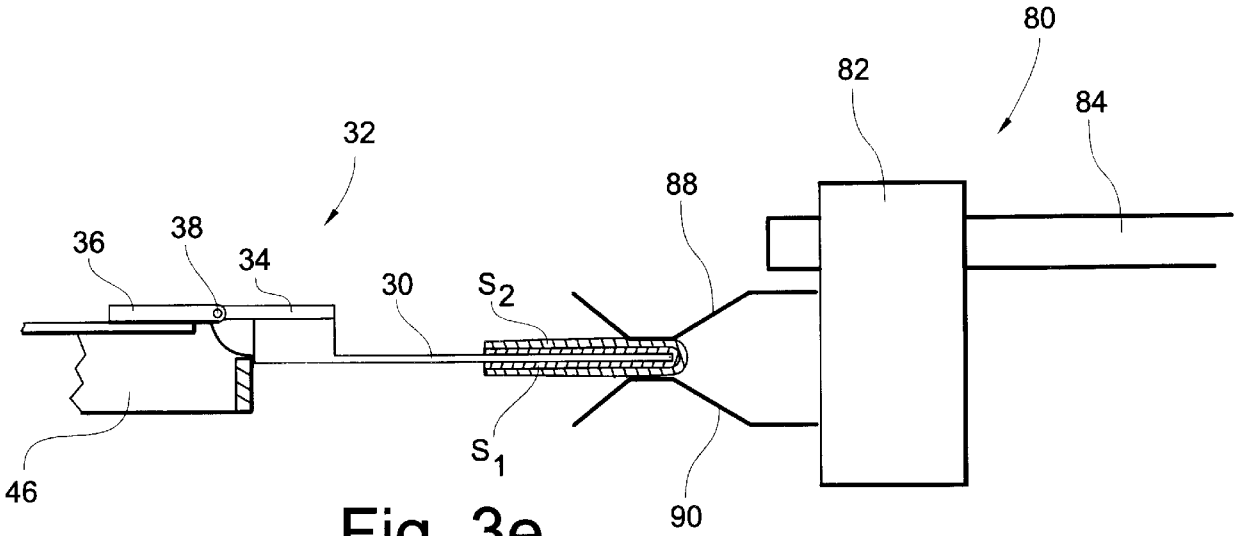
FIG. 3*e* is a side view of a nested pair of socks with the socks being gripped by the doffer.
Figure 3F:
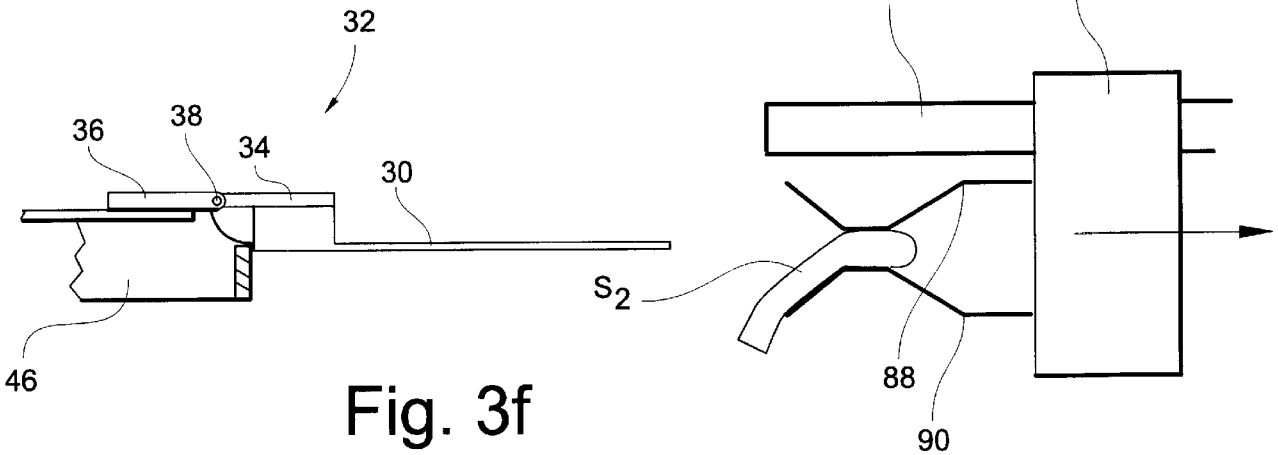
FIG. 3*f* is a side view of a nested pair of socks having been doffed from the first process board.

Having completed processing, the socks S1, S2 are now ready for doffing. The turntable 46 is indexed to a position wherein the socks S1, S2 are disposed intermediate the gripping arms 88, 90 which are cause to move inwardly toward one another to a position adjacent one another for gripping the socks as seen in FIG. 3*e*. Next, as seen in FIG. 3*f*, the housing 82 is retracted along the support rail 84 which causes the socks S1, S2 to be withdrawn from the process/indexing board 30.

Figure 3G:
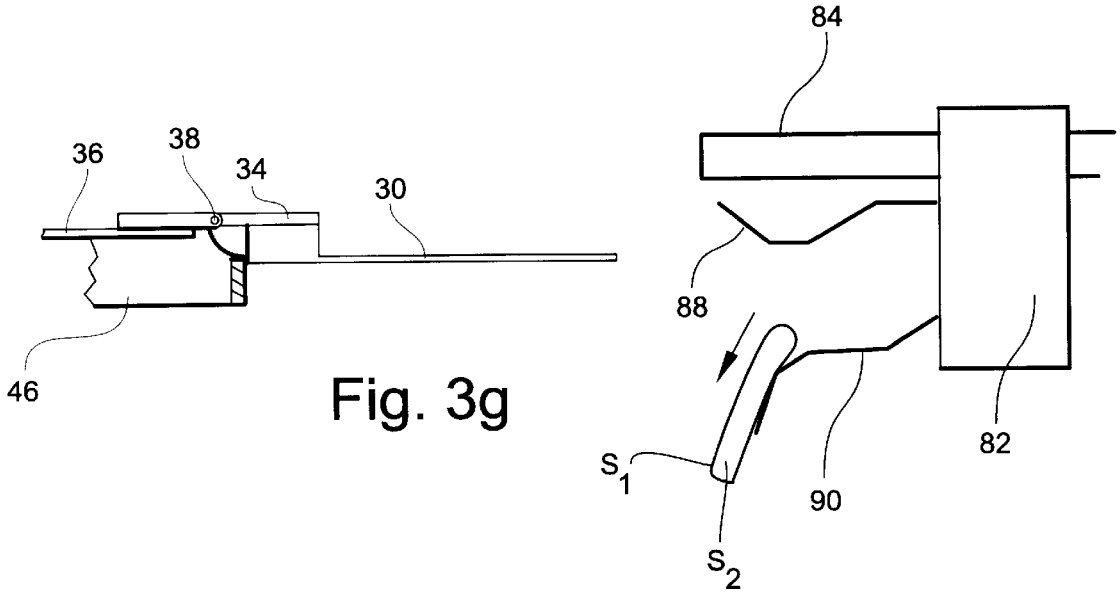
FIG. 3*g* is a side view of a nested pair of socks being released by the doffer.
Figure 4:
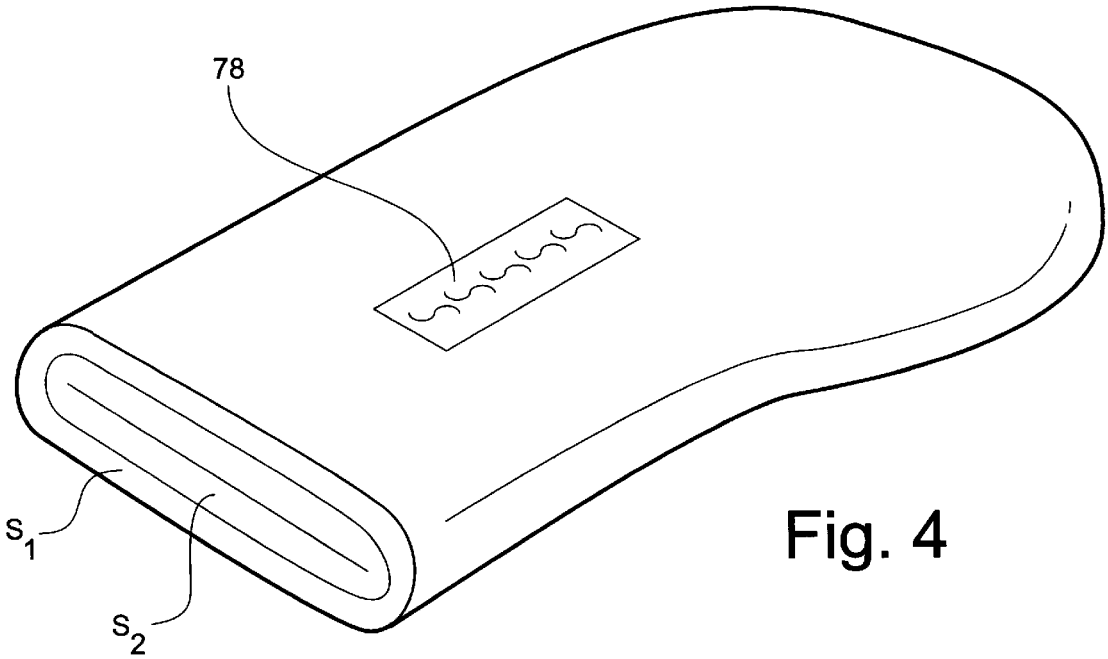
FIG. 4 is a side view of a finished pair of socks in a nested condition.

As seen in FIG. 3*g*, the arms 88, 90 are then caused to part and move to a position spaced from one another which releases the socks S1, S2 into a collection box or other collection structure. A pair of finished, pressed, printed socks are illustrated in FIG. 4.

Figure 5:
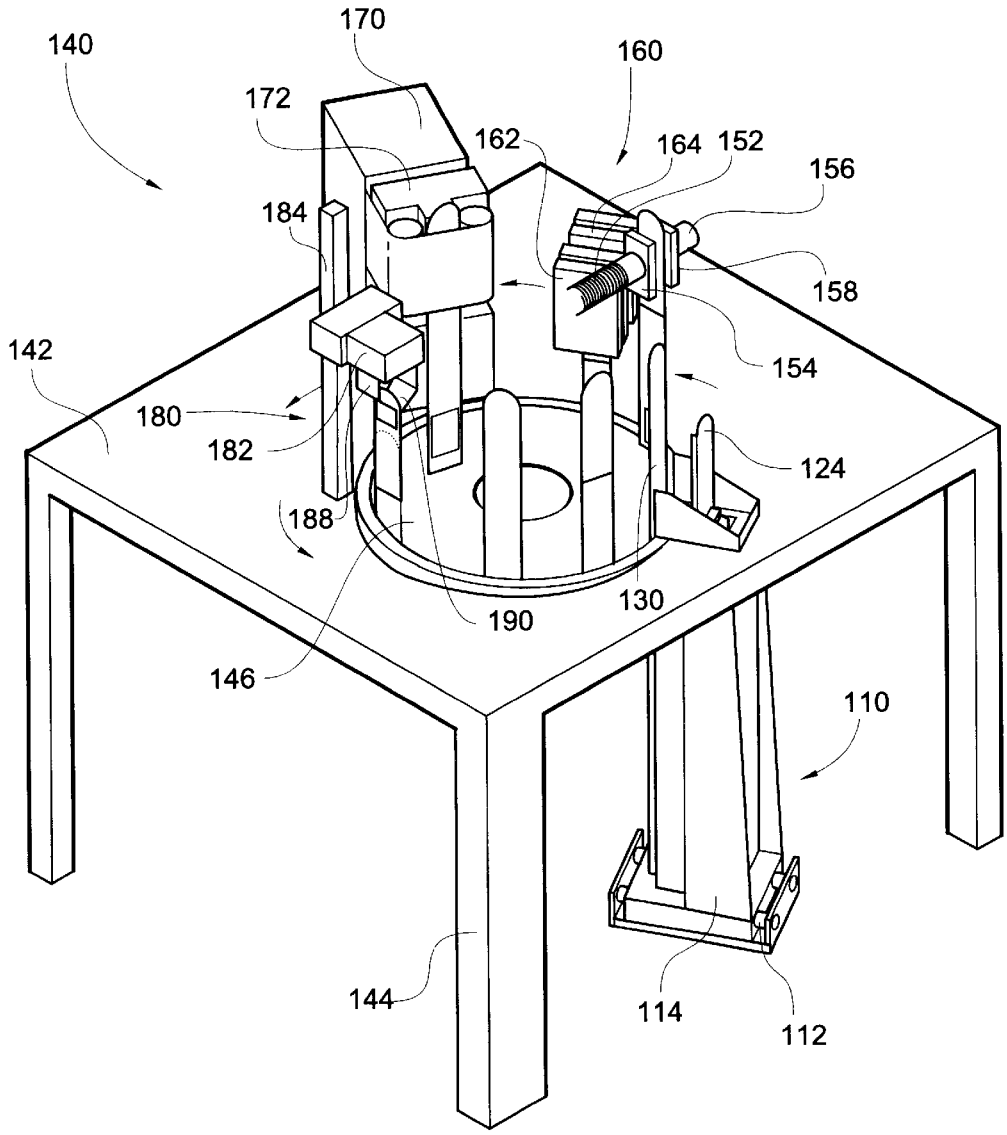
FIG. 5 is a perspective, diagrammatic view, of an apparatus for processing socks according to the second preferred embodiment of the present invention.
Figure 6:
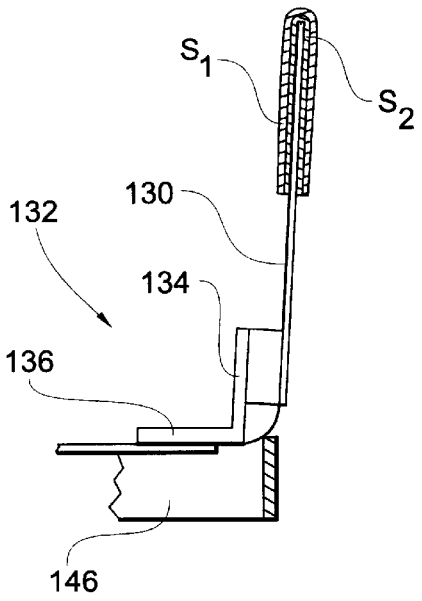
FIG. 6 is a side view of the nested pair of socks disposed on the first process board of the second preferred embodiment in a vertically extended manner.
Figure 6A:
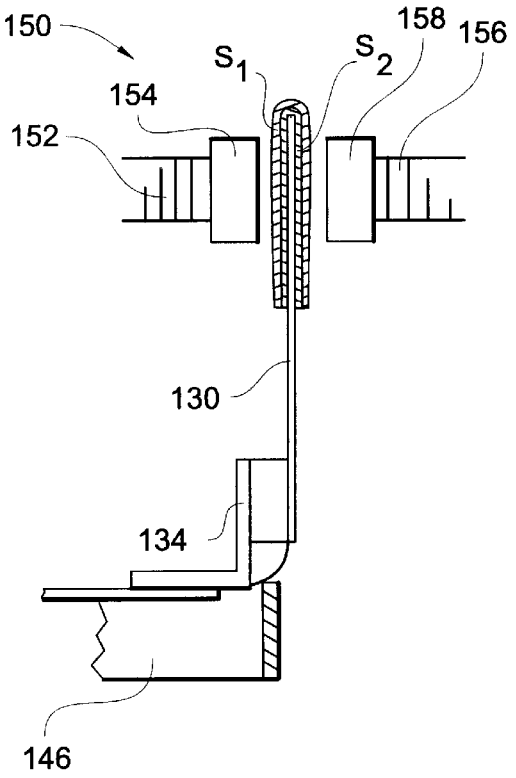
FIG. 6*a* is a side view of a nested pair of socks being addressed by the trimmer.
Figure 6B:
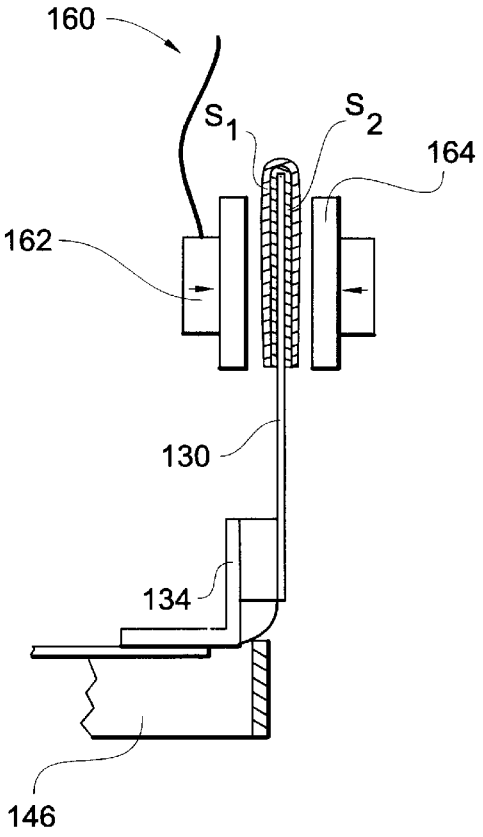
FIG. 6*b* is a side view of a nested pair of socks being addressed by the presser.
Figure 6C:
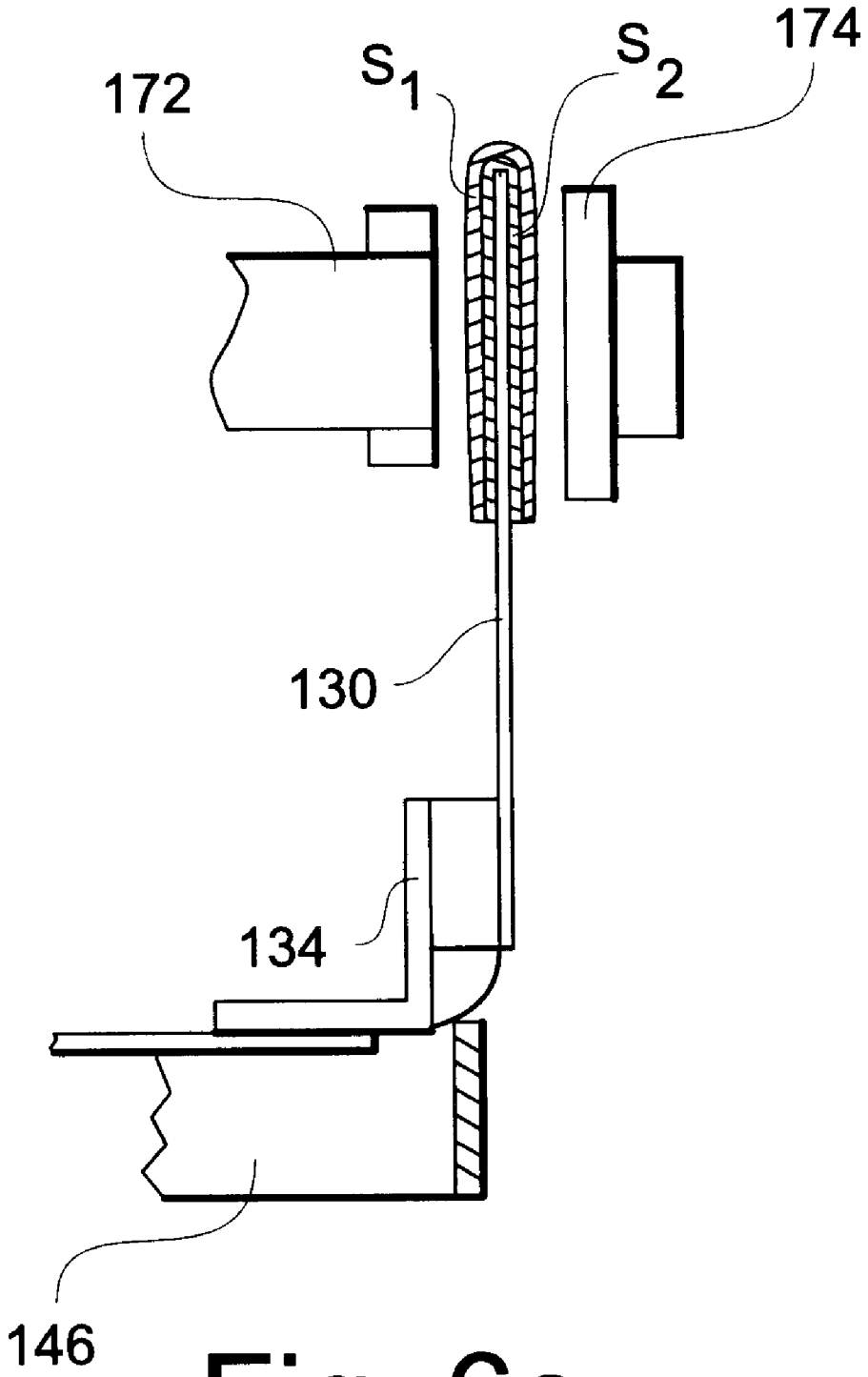
FIG. 6*c* is a side view of a nested pair of socks being addressed by the printer.
Figure 6D:
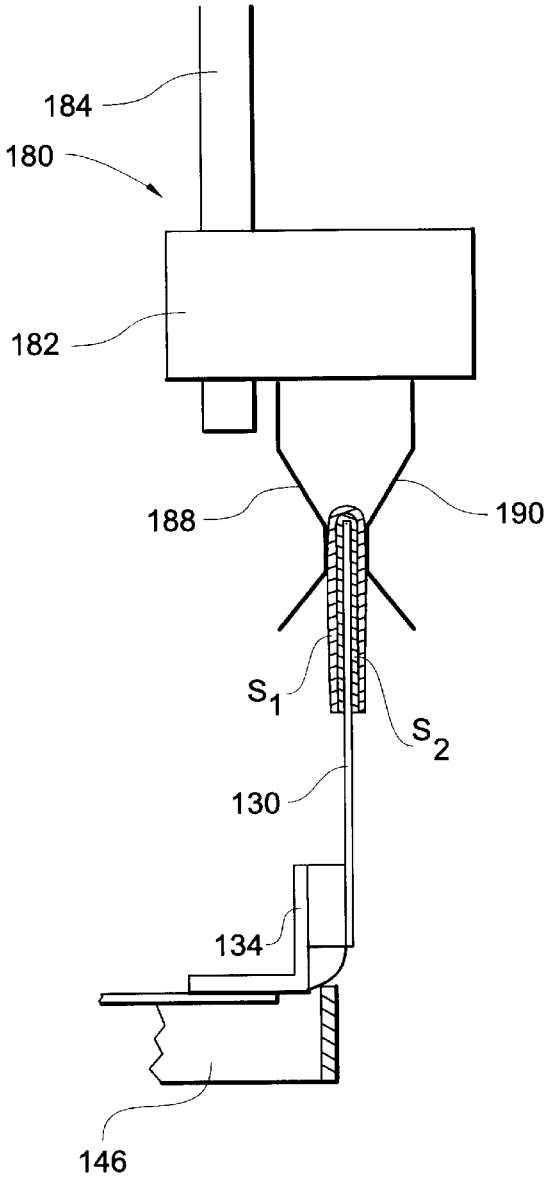
FIG. 6*d* is a side view of a nested pair of socks with the socks being gripped by the doffer.
Figure 6E:
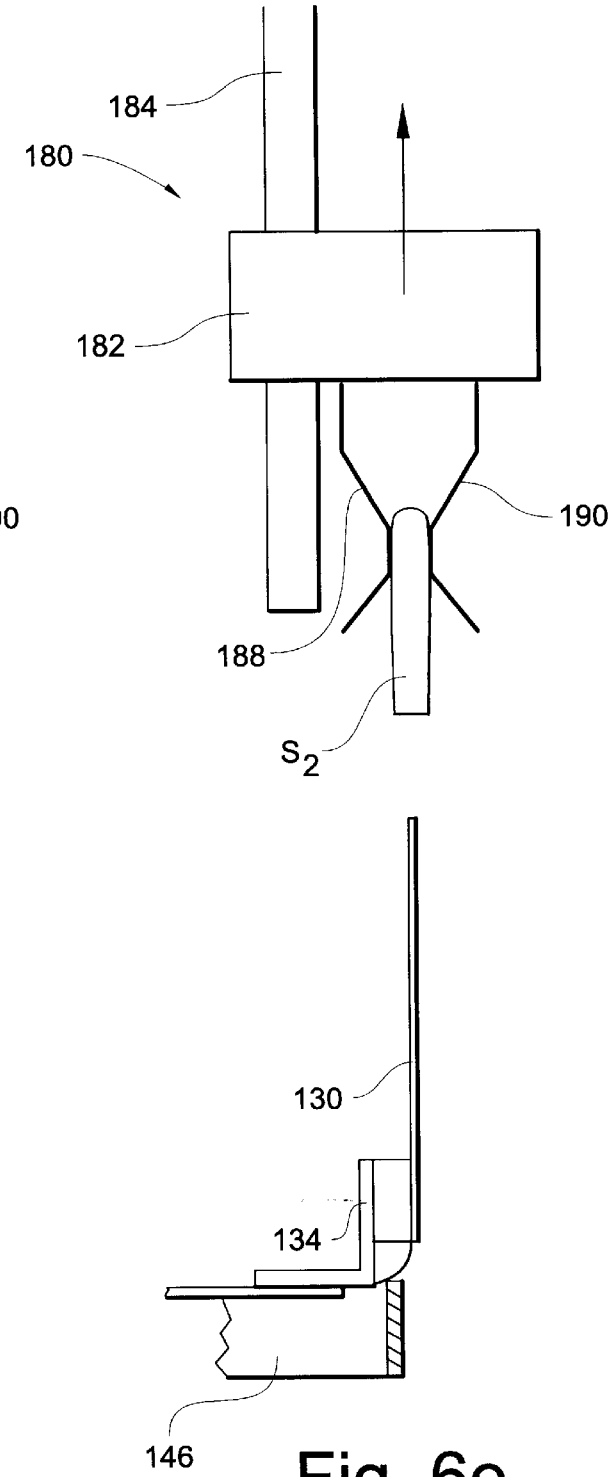
FIG. 6*e* is a side view of a nested pair of socks having been doffed from the first process board.
Figure 6F:
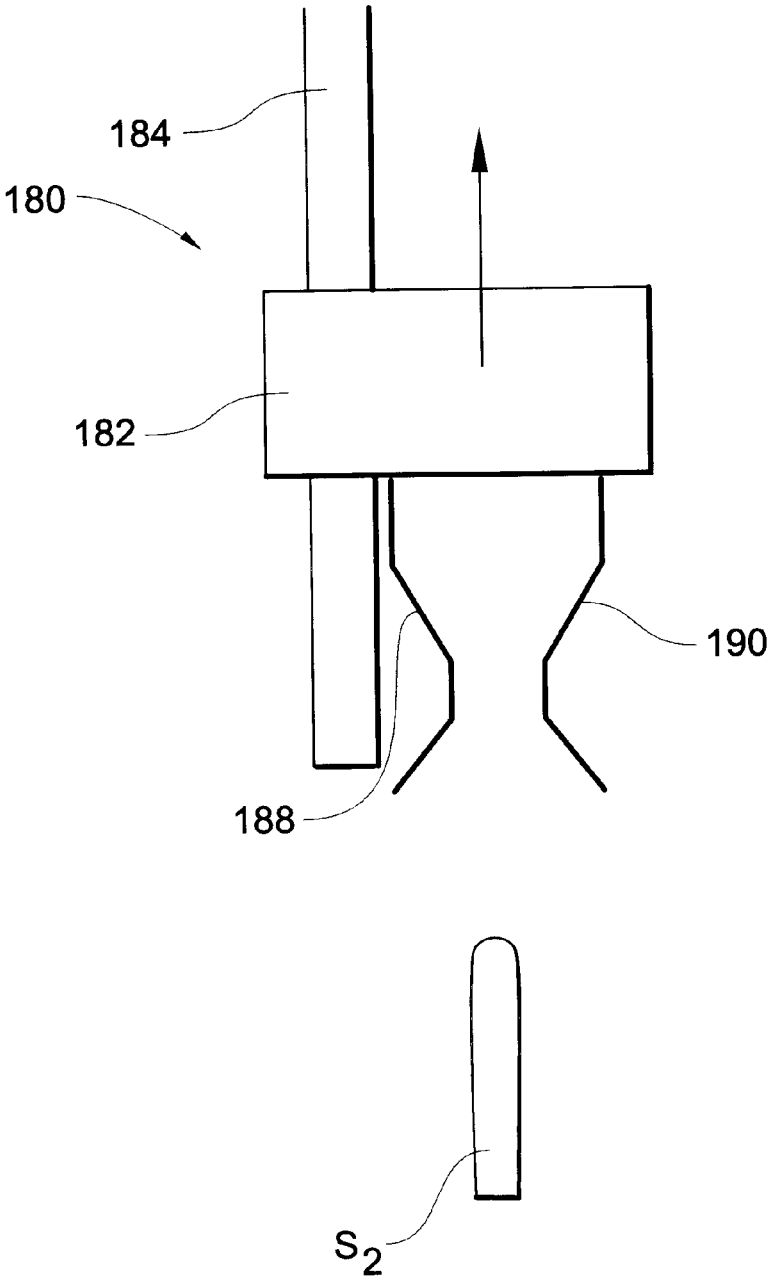
FIG. 6*f* is a side view of a nested pair of socks being released by the doffer.

An alternate preferred embodiment of the present invention is shown in FIGS. 5 and 6–6*f* and designated generally by the numeral 140. As in the first preferred embodiment, the alternate preferred embodiment includes a sock nesting station or sock nester 110 for directing an individual sock into an overlying or nesting relationship with another individual sock and a plurality of sock processing stations disposed in a generally circular array for processing the nested socks through a series of finishing operations. As in the first preferred embodiment, the alternate preferred embodiment includes a frame formed by a horizontally oriented platform 142 supported by floor standing legs 44 disposed at each corner of the platform 142 and an indexing turntable 146 disposed within an opening within the platform 142 which is powered for rotating indexing movement.

Referring specifically to FIG. 5, a plurality of generally elongate first processing boards 130 are vertically disposed at predetermined spacings around the turntable 146 which may be configured for indexing in either a counterclockwise or clockwise order, and is preferably configured to advance in a counterclockwise manner. In the second preferred embodiment, the first processing boards 130 are configured to remain in a generally vertically oriented position for the sock nesting and for the remainder of the processing steps. The processing stations are disposed in an order which optimizes the utilization of the present invention for carrying the nested socks through the finishing operations. Following the sock nesting station 110, the next station is a trimmer 150 which includes two generally rectangular housings 154, 158 which are arranged in an opposed, spaced relationship with the spacing being sufficient to pass a pair of nested socks supported on a processing board therethrough. The housings 154, 158 contain cutters (not shown) for trimming unnecessary textile material which may be projecting from the surface of the socks. Vacuum hoses 152, 156 are connected to the housings 154, 158 for removal of the textile remnants.

From the trimmer 150, the nested pair of socks proceeds to a pressing apparatus 160 which includes two heated platens 162, 164 which are disposed in a spaced parallel relation with one another and configured for movement between a position in pressing relation with the nested sock pair and a position away from the nested sock pair for movement of the nested sock pair through the pressing apparatus 160. Following the pressing apparatus 160, a printer 170 is provided which includes an ink platen 172 for movement into and out of printing relation with a pair of socks disposed within the printer 170. It should be understood that the printer 170 can be one of several types depending on the specific requirements of the user of the apparatus. Next, a free position may be provided for inclusion of other processing devices, as may be necessary, for example, a cuffing station may fill the free position.

The final processing station of the second preferred embodiment is a doffing station 180 which includes a generally rectangular, elongate vertical rail 184 projecting away from and above the platform 142. A sliding housing 182 is mounted to the rail 184 for selective sliding movement there along. Two arms, 188, 190 project outwardly from the housing 182 in a curved manner for grasping a pair of socks disposed on the first processing board 130 intermediate the doffing station 180. The arms 188, 190 are movable between a position for grasping socks and a position for releasing socks. In addition, a slide 192 is provided for guiding the released socks into a collection apparatus.

As in the first preferred embodiment, the nesting station 110 of the second preferred embodiment provides an assembly for automatically arranging individual socks into generally flattened, nested pairs. The nesting assembly 110 of the second preferred embodiment, and operation thereof, including the first processing/indexing board 130 and the process/opening board 124, is substantially similar to the nesting station or nester of the first preferred embodiment. Thus, components of the nesting assembly of the second preferred embodiment corresponding to the components of the first preferred embodiment shown in FIGS. 1–4, bear like reference numerals but in the 100 series. For the sake of simplicity, the components of the nesting assembly of the second preferred embodiment will not be discussed in detail herein and reference is made to the detailed description of the nesting assembly of the first preferred embodiment.

In operation, and with references to FIGS. 6–6*f*, a second sock S2 is placed on the process/index board 130 and a first sock S1 is placed on the process/opening board 124 and the socks are indexed through the nesting station 110 so that the first sock S1 overlies the second sock S2 and the nested socks S1, S2 are disposed on the vertically extending process/index board 130, as shown in FIG. 6. From there, as seen in FIG. 6*a*, the process/index board remains in a vertical position and is indexed to a position intermediate the trimmer 150. The nested pair then continue to a position within the pressing unit 160 where they are pressed by the heated platens 162, 164 (see FIG. 6*b*). After the pressing occurs, the next indexing step positions the nested socks intermediate the platens of printing unit 172 wherein information is affixed to the sock S1 (see FIG. 6*c*). Finally, the socks S1, S2 are ready for doffing and the socks are indexed to a position intermediate the gripping arms 188, 190 of the doffing station 180. As seen in FIG. 6*d*, the gripping arms 188, 190 are to move inwardly toward one another to a position adjacent one another for gripping the socks. Next, the housing 182 is retracted upwardly along the vertically support rail 184 which causes the socks S1, S2 to be withdrawn for the process/indexing board 130 as shown in FIG. 6*e*. In the final step, as seen FIG. 6*f*, the arms 188, 190 are caused to part and move to a position spaced from one another which releases the socks S1, S2 onto the slide 192 where they proceed downward into a collection box or other collection structure.

By the above, the present invention provides a rapid, effective apparatus for performing a plurality of finishing operations on a nested pair of socks with the socks being initially applied to the apparatus singly.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for nesting socks in a generally flattened condition for processing wherein a first sock having an inner surface and an outer surface is disposed in an overlying relation with a second sock having an inner surface and an outer surface, with both socks being in the resultant generally flattened condition, said apparatus comprising:

a frame;

means mounted to said frame for supporting and positioning the second sock in an extended generally flattened condition for overlying by the first sock;

means mounted to said frame for supporting the first sock in an extended, generally flattened condition including means for retaining the first sock with one end thereof in an opened condition sufficient to receive the second sock in a generally extended and flattened condition; and means mounted to said frame for directing the first sock into an overlying relationship with the second sock resulting in the outer surface of the second sock being in contact with the inner surface of the first sock, thereby nesting the socks.

2. An apparatus for nesting socks according to claim 1 wherein said means for supporting and positioning the second sock includes a first process board formed as an elongate flattened member projecting outwardly from a support and sized to receive a sock in an overlying relationship therewith.

3. An apparatus for nesting socks according to claim 1 wherein said means for supporting the first sock includes a second process board formed as an elongate flattened member projecting outwardly from a support and sized to receive a sock in an overlying relationship therewith and said means for retaining the first sock with one end thereof in an opened condition includes at least one tapered rail attached to said second process board to taper from a narrow extent adjacent a distal end of said second process board to a wide extent adjacent a base portion of said second process board.

4. An apparatus for nesting socks according to claim 1 wherein said means for directing the first sock into an overlying relationship with the second sock includes a first slider mounted to said second process board and a first rail operatively engaged with said first slider for sliding movement of said first slider therealong, said first rail being mounted to said frame, for moving the first sock between a position beyond the outermost extent of said first process board, and a position closely adjacent and substantially parallel with said first process board with at least a portion of said tapered rails overlying edges of said first process board.

5. An apparatus for nesting socks according to claim 4 wherein said frame includes a second slider mounted thereto, said second slider being mounted to at least one floor standing rail for sliding movement therealong, for movement of said frame between a position wherein said second process board is not over said first process board and a position wherein said second process board is over said first process board.

6. An apparatus for nesting socks according to claim 5 wherein said means for directing the first sock into an overlying relationship with the second sock includes a third slider attached thereto and a second rail attached to said frame with said third slider operatively engaged with said second rail for sliding movement of said third slider therealong, for moving said second process board from a position adjacent said floor standing rail to a position for receiving the second sock from an operator.

7. An apparatus for nesting socks according to claim 3 wherein said means f or directing the first sock into an overlying relationship with the second sock includes a third slider attached thereto and a vertically extending second rail attached to said frame with said third slider operatively engaged with said second rail for vertical sliding movement of said third slider therealong, movement of said second process board from a position adjacent a support surface to a position for receiving the second sock from an operator, a first slider mounted to said second process board and a first vertically extending rail operatively engaged with said first slider for sliding movement of said first slider therealong, said first rail being mounted to said frame, for vertical movement of said second process board vertically between a position beyond the outermost extent of said first process board, and a position closely adjacent and substantially parallel with said first process board with at least a portion of said tapered rails overlying edges of said first process board, and wherein said frame includes a second slider mounted thereto, said second slider being mounted to at least one horizontally extending rail mounted to the support surface for horizontal sliding movement therealong, for movement of said frame between a position wherein said second process board is not over said first process board and a position wherein said second process board is over said first process board, all being for sequential movement of said second process board vertically from a position adjacent said support surface, to a first extended position for placement of the first sock on the second process board by an operator, vertical movement of said second process board to a position beyond the outermost extent of said first process board, horizontal movement of said second process board to a position over said first process board, vertical movement of said second process board to a position closely adjacent and substantially parallel with said first process board, and vertical movement of said second process board to a position adjacent said support surface, resulting in the movement of the first sock into an overlying relationship with the second sock.

8. An apparatus for processing socks in pairs in a generally flattened nested condition, wherein a first sock having an inner surface and an outer surface is disposed in an overlying relation with a second sock having an inner surface and an outer surface, with both socks being in the resultant generally flattened condition, and the socks enter said apparatus individually and emerge from said apparatus in a paired condition for packaging prior to shipment, said apparatus comprising:

a first floorstanding frame including a platform supported on vertically extending support members, an indexing turntable rotatably mounted to said platform;

a second frame associated with said first frame;

means mounted to said second frame for supporting and positioning the second sock in an extended generally flattened condition for overlying by the first sock;

means mounted to said turntable for supporting the first sock in an extended, generally flattened condition including means for retaining the first sock with one end thereof in an opened condition sufficient to receive the second sock in a generally extended and flattened condition;

means mounted to said second frame for directing the first sock into an overlying relationship with the second sock resulting in the outer surface of the second sock being in contact with the inner surface of the first sock, thereby nesting the socks;

means for processing the nested socks mounted to said first frame adjacent said turntable; and means for doffing the socks from said means for supporting and positioning the second sock, disposed adjacent said first frame.

9. An apparatus for processing socks in pairs according to claim 8 wherein said means for processing the nested socks includes a trimmer for removal of unnecessary textile matter projecting form the outer surface of at least the first sock.

10. An apparatus for processing socks in pairs according to claim 8 wherein said means for processing the nested socks includes a presser to press the nested pair for wrinkle reduction.

11. An apparatus for processing socks in pairs according to claim 8 wherein said means for processing the nested socks includes a printer to selectively print indicia on at least the first sock.

12. An apparatus for processing socks in pairs according to claim 8 wherein said means for doffing the socks includes a pair of arms having movable between an a position where the distal ends of said arms are closely adjacent one another for sock gripping and a position wherein said arms are spaced from one another for sock release, said arm pair being movable to pull the nested socks from said means for supporting and positioning the second sock in an extended generally flattened condition for overlying by the first sock.

13. An apparatus for processing socks in pairs according to claim 8 wherein said means for supporting and positioning the second sock includes a first process board formed as an elongate flattened member projecting outwardly from a support and sized to receive a sock in an overlying relationship therewith.

14. An apparatus for processing socks in pairs according to claim 13 wherein said means for supporting the first sock includes a second process board formed as an elongate flattened member projecting outwardly from a support and sized to receive a sock in an overlying relationship therewith and said means for retaining the first sock with one end thereof in an opened condition includes at least one tapered rail attached to said second process board to taper from a narrow extent adjacent a distal end of said second process board to a wide extent adjacent a base portion of said second process board.

15. An apparatus for processing socks in pairs according to claim 14 wherein said means for directing the first sock into an overlying relationship with the second sock includes a first slider mounted to said second process board and a first rail operatively engaged with said first slider for sliding movement of said first slider therealong, said first rail being mounted to said frame, for moving the first sock between a position beyond the outermost extent of said first process board, and a position closely adjacent and substantially parallel with said first process board with said first process board with at least a portion of said tapered rails overlying edges of said first process board.

16. An apparatus for processing socks in pairs according to claim 15 wherein said frame includes a second slider mounted thereto, said second slider being mounted to at least one floor standing rail for sliding movement therealong, for movement of said frame between a position wherein said second process board is not over said first process board and a position wherein said second process board is over said first process board.

17. An apparatus for processing socks in pairs according to claim 16 wherein said means for directing the first sock into an overlying relationship with the second sock includes a third slider attached thereto and a second rail attached to said second frame with said third slider operatively engaged with said second rail for sliding movement of said third slider therealong, for moving said second process board from a position adjacent said floor standing rail to a position f or receiving the second sock from an operator.

18. An apparatus for processing socks in pairs according to claim 14 wherein said means for directing the first sock into an overlying relationship with the second sock includes a third slider attached thereto and a vertically extending second rail attached to said second frame with said third slider operatively engaged with said second rail for vertical sliding movement of said third slider therealong, for moving said second process board from a position adjacent a support surface to a position for receiving the second sock from an operator, a first slider mounted to said second process board and a first vertically extending rail operatively engaged with said first slider for sliding movement of said first slider therealong, said first rail being mounted to said second frame, for moving said second process board between a position beyond the outermost extent of said first process board, and a position closely adjacent and substantially parallel with said first process board, and wherein said second frame includes a second slider mounted thereto, said second slider being mounted to at least one horizontally extending rail mounted to the support surface for sliding movement therealong, for movement of said second frame between a position wherein said second process board is not over said first process board and a position wherein said second process board is over said first process board, all being for sequential movement of said second process board vertically from a position adjacent said support surface, to a first extended position for placement of the first sock on the second process board by an operator, vertical movement of said second process board to a position beyond the outermost extent of said first process board, horizontal movement of said second process board to a position over said first process board, vertical movement of said second process board to a position closely adjacent and substantially parallel with said first process board, and vertical movement of said second process board to a position adjacent said support surface, resulting in the movement of the first sock into an overlying relationship with the second sock.

19. An apparatus for nesting socks in a generally flattened condition for processing wherein a first sock having an inner surface and an outer surface is disposed in an overlying relation with a second sock having an inner surface and an outer surface, with both socks being in the resultant generally flattened condition, said apparatus comprising:

a frame;

a first process board formed as an elongate flattened member projecting outwardly from a support and sized to receive a sock in an overlying relationship therewith, mounted to said frame for supporting and positioning the second sock in an extended generally flattened condition for overlying by the first sock;

a second process board formed as an elongate flattened member projecting outwardly from a support and sized to receive a sock in an overlying relationship therewith mounted to said frame for supporting the first sock in an extended, generally flattened condition and at least one tapered rail attached to said second process board to taper from a narrow extent adjacent a distal end of said second process board to a wide extent adjacent a base portion of said second process board means for retaining the first sock with one end thereof in an opened condition sufficient to receive the second sock in a generally extended and flattened condition; and a third slider attached thereto and a vertically extending second rail attached to said frame with said third slider operatively engaged with said second rail for vertical sliding movement of said third slider therealong, for movement of said second process board from a position adjacent a support surface to a position for receiving the second sock from an operator, a first slider mounted to said second process board and a first vertically extending rail operatively engaged with said first slider for sliding movement of said first slider therealong, said first rail being mounted to said frame, for movement of said second process board between a position beyond the outermost extent of said first process board, and a position closely adjacent and substantially parallel with said first process board with said first process board with at least a portion of said tapered rails overlying edges of said first process board, and wherein said frame includes a second slider mounted thereto, said second slider being mounted to at least one horizontally extending rail mounted to the support surface for sliding movement therealong, for movement of said frame between a position wherein said second process board is not over said first process board and a position wherein said second process board is over said first process board, all being for sequential movement of said second process board vertically from a position adjacent said support surface, to a first extended position for placement of the first sock on the second process board by an operator, vertical movement of said second process board to a position beyond the outermost extent of said first process board, horizontal movement of said second process board to a position over said first process board, vertical movement of said second process board to a position closely adjacent and substantially parallel with said first process board, and vertical movement of said second process board to a position adjacent said support surface, resulting in the movement of the first sock into an overlying relationship with the second sock.

20. An apparatus for processing socks in pairs according to claim 8 wherein said means for doffing the socks includes a pair of rotatable arms being movable between a position where the distal ends of said arms are closely adjacent one another for sock gripping and a position wherein said arms are spaced from one another for sock release, said arm pair being vertically movable to pull the nested socks from said means for supporting and positioning the second sock in an extended generally flattened condition for overlying by the first sock.

21. An apparatus for processing socks in pairs according to claim 8 wherein said means for supporting and positioning the second sock includes a first process board formed as a vertically extending, elongate flattened member projecting upwardly from a support and sized to receive a sock in an overlying relationship therewith.

* * * * *